US006584908B2

(12) United States Patent
Alford

(10) Patent No.: US 6,584,908 B2
(45) Date of Patent: Jul. 1, 2003

(54) DEVICE FOR THE DISRUPTION OF EXPLOSIVE OBJECTS

(76) Inventor: Sidney Christopher Alford, 41 A Pickwick, Corsham, Wiltshire (GB), SN103 OHX ( * ) Notice: Subject to any disclaimer, the term of this patent is extended or adjusted under 35 U.S.C. 154(b) by 0 days.

(21) Appl. No.: 09/771,235

(22) Filed: Jan. 26, 2001

(65) Prior Publication Data

US 2002/0096079 A1 Jul. 25, 2002

(30) Foreign Application Priority Data

Jan. 19, 2001 (GB) ..... 0101394

(51) Int. Cl.[7] ..... F42D 5/04

(52) U.S. Cl. ..... 102/302; 102/307; 102/309; 102/476; 86/49; 86/50

(58) Field of Search ..... 102/302, 306, 102/307, 309, 476; 86/49, 50

(56) References Cited

U.S. PATENT DOCUMENTS 3,103,882 A * 9/1963 Gilliland ..... 102/309
3,382,800 A * 5/1968 Biggs, Jr. ..... 102/476 X
4,160,413 A * 7/1979 Ridgeway ..... 102/306
4,658,726 A * 4/1987 Held ..... 102/306 X
4,905,601 A * 3/1990 Gabriel et al. ..... 102/307
4,955,939 A * 9/1990 Petrousky et al. ..... 102/306 X
5,124,051 A * 6/1992 Bircher et al. ..... 149/124 X
5,936,184 A * 8/1999 Majerus et al. ..... 89/1.13
6,127,591 A * 10/2000 Shah ..... 588/202 X
6,269,725 B1 * 8/2001 Cherry ..... 86/50
6,302,026 B1 * 10/2001 Parkes ..... 102/324 X

FOREIGN PATENT DOCUMENTS

GB 2292445 6/1992

* cited by examiner

*Primary Examiner*—Peter A. Nelson
(74) *Attorney, Agent, or Firm*—Ryan Kromholz & Manion, S.C.

(57) ABSTRACT

A disrupter has a plastic box 1 with three semi-cylindrical plastic formers 2 each with a bag 4 containing water. Sheet explosive 13 is applied to the back of the formers.

Bags 4 may be filed with materials other than water, for example decontaminent e.g. sodium hypochlorite.

The formers may be replaced by a single former with three recesses.

27 Claims, 2 Drawing Sheets

DEVICE FOR THE DISRUPTION OF EXPLOSIVE OBJECTS

The present invention relates to a device for the disruption of explosive ordinance.

Bombs, mines and explosive employed by terrorists and criminals are most commonly improvised explosive devices (IEDs) rather than the conventional munitions (CMs) manufactured for military use. They differ from such military devices in that, with the exception of such small devices as may be made from steel pipe and end-caps, they are most commonly made using containers which are relatively less robust and manufactured for other everyday purposes. These include paper and plastic bags, briefcases, dustbins and beer kegs. Particular problems are encountered when such IEDs are very large and their construction cannot be ascertained. An example is a large vehicle which is laden with explosive material and which may be provided with more than one means of initiation.

The walls of such containers are much more easily penetrated than are those of conventional munitions and a commonly employed method of rendering them safe consists of projecting a mass of water at them. The intention of the method is penetration of the container and tearing it apart or pressurising it to the extent that it bursts, thereby separating the components so quickly that the initiation system does not have time to function. The most common means of thus disrupting IEDs is a heavy steel gun barrel which employs a blank cartridge to discharge a mass of water. This has sufficient velocity to penetrate the wall of many IEDs but is much less likely to cause the explosion or deflagration of their contents than ore projectiles of other materials such as metal. The very high thermal capacity of water limits the temperature rise of the projectile material much more than that imparted to metal projectiles. Since the increments of water originating from the muzzle end of the gun attain a lower velocity than those increments originating from the breach end and accelerated along the entire length of the barrel, the projectile consists of a slug of water with a velocity gradient along the length with the rearmost components travelling fastest. This inherent instability causes the slug of water, once inside its IED target, to scatter violently sideways and to disrupt the target contents.

The effectiveness of such a water jet is mitigated by inherent limitations of velocity obtainable by means of such gun barrels as well as by the instability of the projectile. Muzzle velocities can be increased by the use of heavier and faster burning propellant charges, by longer barrels and by choking the barrel, but such increase is subject to the law of diminishing returns.

A further limitation of disruptors based upon the gun barrel principle is the recoil generated. This exceeds the holding ability of many remote-controlled vehicles used for the deployment of such disruptors. If such a disruptor is fired with inadequate restraint the gun then constitutes a potentially dangerous projectile capable of inflicting greater damage than many small or badly constructed IEDs.

One of my earlier inventions, described in British Patent Specification GB2292445, consists of a disruptor which combines the advantages of high explosive as a propellant with water as a projectile. Unlike conventional deflagrating propellents, high explosive does not need a heavy container to generate extremely high propulsive pressures and imparts directionality to the aqueous projectile by a different mechanism. According to this invention the device is in the form of a shaped charge and water, or some other liquid or liquescent substance, is used to line or to fill the cavity. Like convention meal-lined shaped charges, this device may be used in radially symmetrical forms or in linear forms.

In its radially symmetrical form in particular the velocity of the jet of water enabled it to penetrate the steel or iron body of a mortar bomb and, by suddenly increasing the pressure of the contents, to eject the fuse and booster without explosive reaction.

In its linear embodiment and elongate explosive charge is provided with a cavity which is filled with water.

Since such charges are most conveniently designed using light plastics containers, the assembly disintegrates upon firing and no effective recoil is applied to the means of support. They may therefore be deployed by the smallest of remote-controlled vehicles.

Yet another invention generates a powerful linear jet of water by the simultaneous initiation of two elongate and parallel charges of high explosive each of which is placed along the long axis of a cylindrical container of water. Each charge increment generates a rapidly expanding cylinder of water and, as these two expanding masses collide, a flat elongate jet of water is generated and projected towards the target. A disadvantage of this apparatus is that a similar and equally energetic jet of water is projected in the rearward direction. Since disruptors of this type were intended for the disruption of large vehicle bombs, they are necessarily very large and cumbrous and use tens of kilogrammes of high explosive. One means of deployment of such a large disruptor is a remote controlled vehicle of great expense which is destroyed as the disruptor functions. Further expense may be caused by the rearwardly directed jet and the shock wave produced by the device. This expense is perceived as especially regrettable of the target is subsequently recognized as having not been a functional IED in the first place.

In the case of each of the above inventions a disruptor of a given size will, at a given distance from a target, strike a given area of that target. Since it may be considered necessary or desirable for the effective disruption of that target to strike a larger area of that target, it is necessary in each case either to use a multiplicity of disruptors, all initiated simultaneously, or to use a larger disruptor. The use of a multiplicity of disruptors increases the amount of explosive and the overall charge weight in proportion to the area of the target attacked but it complicates deployment and the means of initiation. Simple increase in the size of a single disruptor in order to strike a larger surface area maintains the simplicity of the arrangement but increases disproportionately the amount of explosive and the overall weight of the charge, and increases the penetrating power to an extent that may be undesirable. Doubling the width of the target which is directly attacked, for example, also doubles the height of the target which is attacked and increases the weight of both of the explosive and overall weight eight-fold.

The present invention provides a device for generating a liquid jet, the device comprising an enclosure containing a plurality of formers, each defining a cavity partially enclosed by the former, each of the formers supporting an explosive charge, and a filler material within the cavity, the filler material being a liquid, a gel or a non-metallic solid that will liquefy upon detonation of the device.

The present invention also provides a device for generating a liquid jet, the device comprising an enclosure containing a former with a plurality of cavities each partially enclosed and supporting an explosive charge, and a filler material with each cavity, the filler material being a liquid, a gel, or a non-metallic solid that will liquefy upon detonation of the device.

The present invention also provides a device for generating a liquid jet, the device comprising an enclosure containing at least one former defining a cavity partially enclosed by the former supporting an explosive charge and a filler material within the cavity, wherein the filler material is a decontaminant.

In this way, according to one aspect of the present invention, there is provided a disruptor with multiple explosive charges in a single outer envelope.

Such a disruptor can provide a well-defined, directed explosive charge, for example which can reproduce accurately the actual or anticipated profile of the target.

Additionally or alternatively, a number of the devices of the present invention can be placed together in a modular form to provide a large-area, uniform explosive charge.

In either form, such a charge can be light-weight and can be assembled quickly and easily.

An object of the present invention is to provide a practicable and convenient means of perforating the case of a large improvised explosive device, such as an explosive-laden road vehicle, using high explosive as the propellent and water as the projected material; another object of the invention is to disrupt and disperse the contents of the target munition so rapidly that its initiation system is unable to function.

A particular application of the invention is the rendering safe of and IED consisting of a large vehicles laden with explosive or containing one or more bombs. It is unlikely that the extent of the explosive fill and the position and nature of the initiation system will be known at the time that the device is recognised as bomb or that a decision is taken to treat it as such. Though it may be assumed that certain parts of the vehicle are more likely to contain explosive than others, it is unlikely that the precise position of the initiation system can be ascertained with certainty even if preliminary entry is made by manual or remote means for the purpose of inspection. The presumption must be made that the perceived initiation system may, in fact, not be the real initiation system or that it is duplicated elsewhere. It may therefore be decided that the safest way to proceed in the disruption of the target is to attack that part of the vehicle which is perceived or suspected of containing an IED or explosive material over sufficient area and with sufficient violence to blow it out of the vehicle and disperse it before the initiation system has time to initiate it or, at least, a significant part of it.

In a preferred embodiment, the shape of the outer container used in the present invention is that of a flat cuboid. This makes it simple and practicable to arrange tow or more disruptors so as to extend the area and shape of the target surface attacked. A parallel array of explosive backed semi-cylindrical formers is arranged against one large inner surface of the outer container with their longitudinal edges adjacent or closely spaced. The explosive charge is applied to either or both surfaces of each former and the space inside the semi-cylinders is filled with water. The area of the target surface which is struck by the projectile water thus depends upon the length of the formers and the overall width of the array. This arrangement provides a means of striking the area attacked with an approximately evenly distributed amount of energy while providing a charge weight which is proportional to the area.

In one simple embodiment of the invention the explosive charge and its formers are placed within an outer container which is itself filled with water. This arrangement suffers the inconvenience of requiring a robustly water-tight outer container.

In another embodiment of the invention the necessity of using a container with a sealed lid capable of containing water without leaking is avoided by employing a rigid outer container and placing a flexible plastics or rubber bladder in the D-sectioned space defined by the inside of each semi-cylindrical former and the flat surface upon which its longitudinal edges abut. These bladders are then filled with water.

The energy imparted to the jet generated by a water-lined or water-filled shaped charge may be enhanced by tamping the explosive, thereby prolonging the duration of the pressure applied to the projected water. A simple means of providing such tamping consists of applying a second body of water to the rear and sides of the explosive charge. This water may also advantageously be contained within one or more flexible bladders occupying the space between the inner wall of the outer case and the convex surface of the cylindrical explosive charges. Such an arrangement has the additional advantage of quenching the hot gases generated by the detonating explosive and eliminating the flash, thereby diminishing considerably the incendive nature of the device. This is particularly desirable when disrupting bombs within, or in the vicinity of, motor vehicles or other highly inflammable structures.

It will be understood that the water may be placed in a single bladder and the explosive charges and their formers placed either within a fold of this liner or within this inflatable bladder. The latter arrangement brings the inconvenience of requiring a large sealable aperture for the insertion of these components.

In order that the invention may more readily be understood, a description will be given, by way of example only, reference being made to the accompanying drawings, in which.

Figure 1:
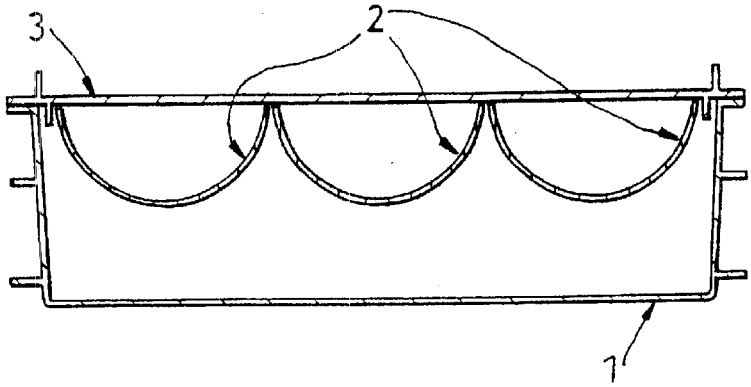
FIG. 1 is a transverse section of a disruptor in which the outer container contains a multiplicity of semi-cylindrical formers.

Referring to FIG. 1 of the drawings, it will be seen that the apparatus illustrated therein comprises a plastics box 1 with an approximately rectangular transverse section. Three semi-cylindrical plastics formers 2 are held against the inside of the lid 3. If a layer of high explosive is attached to the inner or outer surface of each former 2 and all remaining space is filled with water, detonation of the explosive projects the water within the formers 2 violently through the lid 3 of the box 1.

Figure 2:
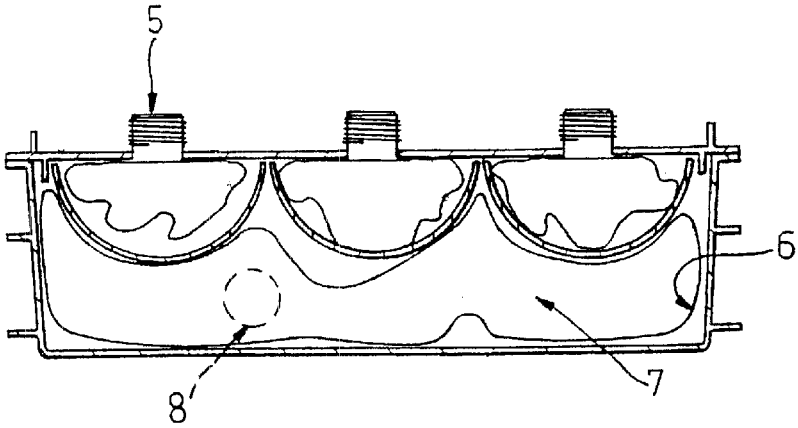
FIG. 2 is a transverse section of a disruptor in which the projected and tamping water is contained within inflatable bladders.

Referring to FIG. 2 of the drawings, an arrangement similar to that of FIG. 1 is provided with an inflatable plastics or rubber bag 4 in each of the formers 2. Each of the three bags 4 is provided with an integral nozzle 5 which passes through holes in the lid 3 in order to allow filling with water once the lid 3 is in place. A further bag 6 occupies the space 7 behind the formers 2 and is filled with water through the nozzle 8 which passes through one end-wall of the box 1.

Figure 3:
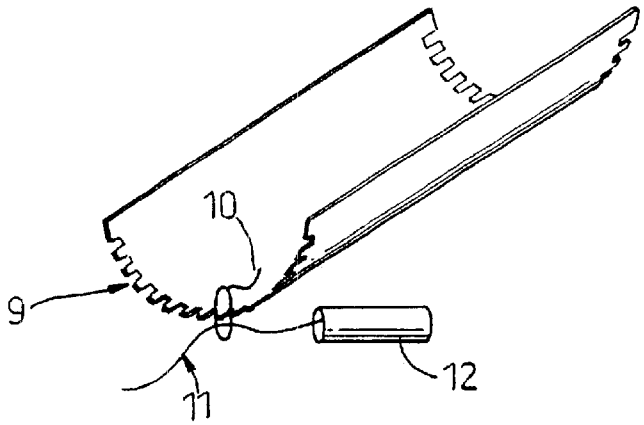
FIG. 3 is a former for imparting the necessary shape to an explosive charge to enable it to be used as a component of a liquid filled linear shaped charge.

Referring to FIG. 3 of the drawings, the former 2 for imparting the necessary shape to an explosive charge consists of a semi-cylindrical plastics extrusion. Its shape may conveniently be semi-cylindrical but other suitable concave shapes, including but not limited to a V-section, may also be used. A common form of explosive for application to such a liner consists of sheet explosive, typically between one and six millimetres thick, which is stuck to the outer or the inner surface. Alternatively detonating cord may be passed longitudinally to and from between the ends along the outside of the former, passing through the notches and round the projections of the crenations 9 at each end. The explosive load may be increased by passing the detonating cord more than once between each corresponding pair of projections, or by passing in one direction along the outside of the former and back in the other direction along the inside. Alternatively, light loads may be arranged by using less detonating cord, leaving the gaps between some adjacent projections empty. Sheet explosive may be used instead of detonating cord. It may conveniently be stuck to either surface of the former using an adhesive or double-sided sticky tape. One or more plastic ties 10 passing through pairs of holes in the former 2 provide a means of securing the tail of the detonating cord. If sheet explosive is used, a length of detonating cord 11 with a tubular explosive booster 12 at its end is secured so that the booster is urged into contact with the sheet explosive 13.

Figure 4:
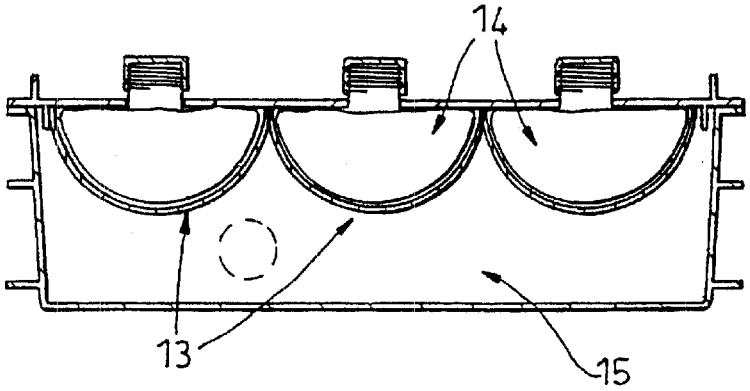
FIG. 4 shows the initiation train of a disruptor containing three formers.

Referring to FIG. 4 of the drawings, a transverse section of the invention shows sheet explosive 13 applied to the backs of the formers 2 and the flexible bags 4 & 6 inflated with projectile water 14 and tamping water 15 respectively.

Figure 5:
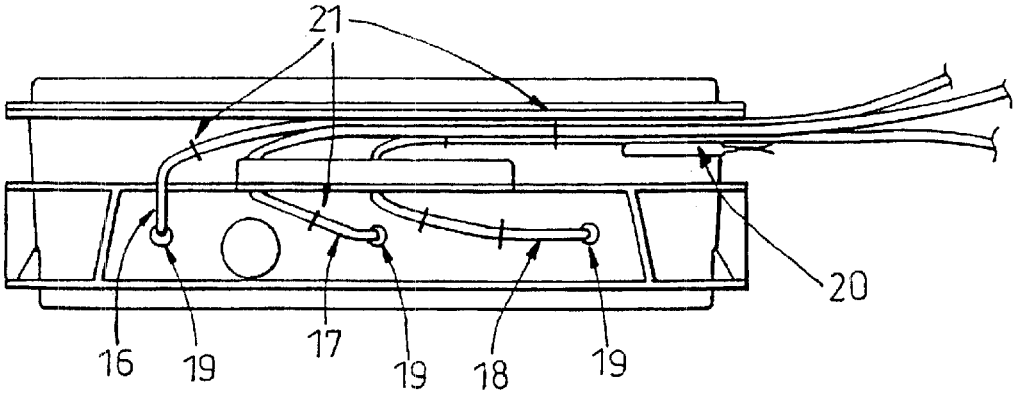
FIG. 5 is the exterior of a disruptor of the present invention.

Referring now to FIG. 5 of the drawings, the end view of an assembled disruptor shows the lengths of detonating cord 16, 17 & 18 emerging through holes 19 in the wall of the box 1 and going to the point of initiation where a detonator 20 is held in contact with them. The detonating cord is held against the surface of the box 1 by means of a multiplicity of plastic ties 21. It will be appreciated that the devious paths taken by the three strands of detonating cord 21 are so determined that each separate strand travels an equal distance between the point of initiation 20 and the former to from which it leads.

Figure 6:
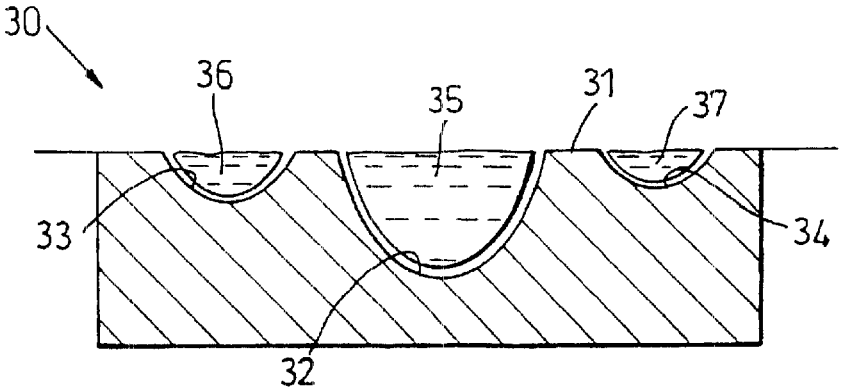
FIG. 6 is a transverse section of another embodiment of disrupter of the present invention.

The disrupter 30 of FIG. 6 comprises a former 31 with three semi-cylindrical recesses of which the central recess 32 is of greater volume than recesses 33 and 34. Bag 35 of water substantially fills recess 32, and bags 36 and 37 of sodium hypochlorite substantially fill recesses 33 and 34. The amount of explosive (not shown) for each recess is proportionate to the volume of the recess and the mass of the material in the recess.

In a variant, the amount of explosive in the central recess 32 is greater than the proportionate amounts in recesses 33, 34 by volume and mass, so that the overall explosive effect will be greater in the central region. Clearly, the proportions of explosive material, the nature of the filling material, and the amounts and density/mass of filling materials, can be changed as required to provide different profiles of explosive effect. All these variants can be used with the disruptor of FIGS. 1 to 5.

A particular advantage of this invention is that the device may be stored and transported with the explosive in situ, but containing no water. This considerably reduces the weight and susceptibility to damage by rough handling. When required for use the inflatable bags may be quickly filled with water obtained locally without any need to open the outer container.

The invention is not limited to the use of detonating cord as a means of initiation. Sufficient simultaneity of initiation of each element can be assured by means of shock-tube detonators provided that equal lengths of shock-tube run between the point of initiation to the proximal part of each explosive charge increment.

Although water has the great advantages as the working fluid in the invention of suitable density, lack of flammability, fire-quenching and heat absorbing properties, cheapness, availability, and complete lack of toxicity, the invention is not limited to the use of pure water as its working fluid. Indeed, the use of separate flexible bags for containing the working fluid and the tamping liquid respectively enables the invention to be employed with two different fluids, of which one provides the projectile and the other the tamping and the means of modifying collateral effects. Thus, and by way of example, the water may have its density raised by the dissolution of inorganic salts, its coherence increased by the addition of long-chain polymeric substances such as the sodium salt of carboxymethylcellulose, and its fire quenching properties augmented by the addition of sodium borate or sodium bircarbonate. For use in cold climates the freezing point of the water may be depressed by the addition of such anti-freeze substances as ethylene glycol, methanol or calcium chloride. The tamping effect of the fluid surrounding the rear and sides of the charge may be enhanced by increasing its density. This may be achieved by the dissolution of inorganic salts or by the incorporation of solid, particulate, substances such as sand or sodium bicarbonate.

Water may also be replaced by a suitable presses or melt-cast solid material. Since explosive materials are less easily initiated by the impact of materials of low melting point, suitable substances are inorganic salts with a high proportion of water of crystallisation. One such substance which has been found particularly effective is disodium hydrogen phosphate dodecahydrate. Another suitable material is sodium bicarbonate which, upon heating, decomposes with the liberation of water and carbon dioxide.

The invention is of particular usefulness if it is required to disrupt a device known or believed to contain a biological pathogen, such as a live bacterium or the spores thereof, or an extremely toxic chemical, such as a nerve gas. In this case disruption of the target munition is likely to disperse the pathogen in the manner intended by the maker of the target. By the use of a concentrated solution of sodium hypochlorite, or some other suitable decontaminant, as the projectile liquid, any such dispersed target material will be intimately mixed with a finely divided cloud of decontaminant and thus rapidly neutralised.

A particular advantage of the invention is that it is a powerful disruptor suitable for large targets even when made such a size as to be easily portable by a single operator. This, as well as its flat, rectangular shape, enables arrays of similar charges to be quickly assembled on a fixed or mobile frame in order to form an array so configured as to attack a target in the most advantageous way.

By Way of Example

A disruptor having a similar cross-section to that shown in FIG. 4 was made in a plastics box 350 mm wide and 550 mm long with a height of 100 mm. Three semi-circular plastics formers were fitted, edge to edge, against the inner face of the lid. Each former was covered on its convex surface by a layer of Detasheet plastic explosive 6 mm thick. This gave a total explosive load of approximately 2.5 kg.

The disruptor was filled with water and placed opposite that part of a transit van within which were stood two plastic bins containing approximately 960 kg of explosive consisting of prilled ammonium nitrate sensitised by the addition of nitromethane and diesel and containing cartridges of gelignite.

Initiation of the disruptor opened a wide hole in the distal side of the van and ejected the explosive-filled bins through the opposite side of the vehicle, most of which was also removed. The bins were ripped apart and the explosive they contained widely dispersed. There was no evidence to suggest that any of the explosive target material had been detonated. The vehicle did not catch fire.

What is claimed is:

1. A device for generating a liquid jet, the device comprising an enclosure containing a plurality of formers, each defining a concave cavity partially enclosed by the former, each of the formers supporting an explosive charge, and a filler material adjacent the charge within the cavity, the filler material being a liquid, a gel or a non-metallic solid that will liquefy upon detonation of the device.

2. A device for generating a liquid jet, the device comprising an enclosure containing a former with a plurality of concave cavities each partially enclosed and supporting an explosive charge, and a filler material adjacent the charge within each cavity, the filler material being a liquid, a gel or a non-metallic solid that will liquefy upon detonation of the device.

3. A device for generating a liquid jet, the device comprising an enclosure containing at least one former defining a cavity partially enclosed by the former supporting an explosive charge and a filler material adjacent the charge within the cavity, wherein the filler material is a biological decontaminant.

4. A device according to claim 3 wherein the decontaminant comprises sodium hypochlorite.

5. A device according to claim 2 wherein the filler material is pressed or melt-cast solid material.

6. A device according to claim 2, wherein the filler material is disodium hydrogen phosphate dodecahydrate.

7. A device according to claim 2 wherein the filler material is sodium bicarbonate.

8. A device according to claim 1 wherein the filler material is contained in a flexible bag.

9. A device according to claim 8 wherein the or each explosive charge, former and bag are placed within the enclosure, the explosive charge and its former being placed within the bag.

10. A device according to claim 8 wherein the explosive charge, the former and the bag are placed within an outer enclosure, the explosive charge and its former being placed within a fold of the bag.

11. A device according to claim 8 further comprising an outer case within which are positioned the explosive charge, the former, the bag within the cavity and a second bag containing filler material positioned at the opposite side of the former to the cavity, within the outer enclosure.

12. A device according to claim 8 wherein the former is semi-cylindrical former and the explosive charge is applied to one or both of the inner and outer surfaces of the bag.

13. A device according to claim 12 wherein the explosive charge is a detonating cord secured to the surface or surfaces.

14. A device according to claim 13 wherein crenations are provided at opposite ends of the former and the detonating cord is passed longitudinally to and from through notches and round projections of the crenations at each end.

15. A device according to claim 12 wherein the detonating cord is also passed along the inside of the former.

16. A device according to claim 14 wherein the notches between some of the projections are left empty, thereby using less detonating cord thus providing lighter loads.

17. A device according to claim 1 wherein the explosive charge is sheet explosive stuck by an adhesive or double-sided sticky tape to the former.

18. A device according to claim 1 wherein the or each flexible bag is contained within an outer container and filled through nozzles projecting from the container.

19. A device according to claim 1 wherein the formers and/or an outer enclosure comprise different filler materials.

20. A device for generating a liquid jet, the device comprising an enclosure containing a former with a plurality of cavities each partially enclosed and supporting an explosive charge, and a filler material within each cavity, the filler material being disodium hydrogen phosphate dodecahydrate adapted tol liquefy upon detonation of the device.

21. A device for generating a liquid jet, the device comprising an enclosure containing a plurality of formers, each defining a cavity partially enclosed by the former, each of the formers supporting an explosive charge, and a filler material within the cavity contained in a flexible bag, the filler material being a liquid, a gel or a non-metallic solid that will liquefy upon detonation of the device, the explosive charge, the former and the bag being placed within an outer enclosure, the explosive charge and its former being placed within a fold of the bag.

22. A device for generating a liquid jet, the device comprising an enclosure containing a plurality of formers, each defining a cavity partially enclosed by the former, each of the formers supporting an explosive charge, a filler material within the cavity contained in a flexible bag, the filler material being a liquid, a gel or a non-metallic solid that will liquefy upon detonation of the device, and an outer case within which are positioned the explosive charge, the former, the bag within the cavity and a second bag containing filler material positioned at the opposite side of the former to the cavity, within the outer enclosure.

23. A device for generating a liquid jet, the device comprising an enclosure containing a plurality of formers, each defining a cavity partially enclosed by the former, each of the formers supporting an explosive charge, and a filler material within the cavity and contained in a flexible bag, the filler material being a liquid, a gel or a non-metallic solid that will liquefy upon detonation of the device, the former being a semi-cylindrical former and the explosive charge being applied to one or both of the inner and outer surfaces of the bag.

24. A device according to claim 23 wherein the explosive charge is a detonating cord secured to the surface or surfaces.

25. A device according to claim 24 wherein crenations are provided at opposite ends of the former and the detonating cord is passed longitudinally to and from through notches and round projections of the crenations at each end.

26. A device according to claim 23 wherein the detonating cord is also passed along the inside of the former.

27. A device according to claim 24 wherein the notches between some of the projections are left empty, thereby using less detonating cord thus providing lighter loads.

* * * * *